US005343926A

United States Patent [19]

Cheskis et al.

[11] Patent Number: 5,343,926

[45] Date of Patent: Sep. 6, 1994

[54] METAL SPRAY FORMING USING MULTIPLE NOZZLES

[75] Inventors: Harvey P. Cheskis, North Haven; W.Gary Watson, Cheshire, both of Conn.; Jeffrey S. Coombs, West Glamorgan, United Kingdom; Peter F. Chesney, Duncanville, Tex.

[73] Assignees: Olin Corporation, New Haven, Conn.; Osprey Metals Limited, West Glamorgan, United Kingdom

[21] Appl. No.: 985,525

[22] Filed: Dec. 3, 1992

Related U.S. Application Data

[63] Continuation of Ser. No. 636,862, Jan. 2, 1991, abandoned.

[51] Int. Cl.[5] ..... B22D 11/06; B22D 23/00

[52] U.S. Cl. ..... 164/46; 164/271; 164/429; 164/479

[58] Field of Search ..... 164/46, 479, 429, 271

[56] References Cited

U.S. PATENT DOCUMENTS

| | | | |
|---|---|---|---|
| Re. 31,767 | 12/1984 | Brooks | 29/527.2 |
| 3,576,207 | 4/1971 | Grenfell | 164/48 |
| 3,670,400 | 6/1972 | Singer | 29/527.5 |
| 3,826,301 | 7/1974 | Brooks | 164/46 |
| 3,909,921 | 10/1975 | Brooks | 29/527.2 |
| 4,114,251 | 9/1978 | Southern et al. . | |
| 4,579,168 | 4/1986 | Singer | 164/480 |

FOREIGN PATENT DOCUMENTS

| | | | |
|---|---|---|---|
| 0225080 | 6/1987 | European Pat. Off. . | |
| 0225732 | 6/1987 | European Pat. Off. . | |
| 2043882 | 3/1971 | Fed. Rep. of Germany | 164/46 |
| 60-145252 | 7/1985 | Japan | 164/46 |
| 1-150438 | 6/1989 | Japan | 164/46 |
| 1-312006 | 12/1989 | Japan | 164/46 |
| 1-312013 | 12/1989 | Japan | 164/46 |
| 1-321049 | 12/1989 | Japan | 164/479 |
| WO87/03012 | 5/1987 | PCT Int'l Appl. . | |
| WO89/12115 | 12/1989 | PCT Int'l Appl. . | |
| WO90/11852 | 10/1990 | PCT Int'l Appl. . | |
| 2172827 | 10/1986 | United Kingdom . | |
| 2172900 | 10/1986 | United Kingdom . | |

OTHER PUBLICATIONS

Iron and Steel Engineer, vol. 65, No. 11, Nov. 1988, pp. 25–29.

*Primary Examiner*—J. Reed Batten, Jr.
*Attorney, Agent, or Firm*—Gregory S. Rosenblatt

[57] ABSTRACT

Metal is spray cast onto a moving substrate using at least two sprays, the first of which has a solid fraction greater than 20% at the time the spray contacts the substrate, but less than the solid fraction of the second spray.

28 Claims, 2 Drawing Sheets

METAL SPRAY FORMING USING MULTIPLE NOZZLES

This application is a continuation of application Ser. No. 07/636,862 filed Jan. 2. 1991, now abandoned.

BACKGROUND OF THE INVENTION

1. Field of the Invention

This invention relates to the formation of metal or metal alloy products by using spray casting techniques. The metal or metal alloy products which are produced according to this invention have a minimum of porosity.

2. Description of Related Art

It is well known in the art that a metal or metal alloy can be made by casting, spray casting into a die or by spray casting onto a substrate to form a particular shape. Casting a metal into a desired shape can be achieved by several different techniques, for example, sand casting, die casting, centrifugal casting, shell molding or investment casting. Articles produced by these methods, however, may possess poor mechanical properties mainly as a result of relatively large grain sizes, structural weaknesses and defects arising from the casting process, e.g., shrinkage and segregation.

The formation of a particular shape by casting involves the casting of a metal or metal alloy as an ingot, followed by a hot working step, e.g., hot rolling, forging, pressing or extruding. The formation of the finished shape is usually completed by a cold working process, e.g., cold rolling, pressing, coining or spinning. In either case, semifinished products (i.e. plates and bars) often have to be manufactured before subsequent processing to produce finished articles.

In the formation of particular shapes by spray casting, complex shaped articles can be manufactured having mechanical properties generally superior to those articles produced by casting the shapes by the first method described above. However, porosity is a major problem in the formation of shapes by spray casting.

Spray casting molten metal into a desired shape is achieved by atomization of the molten metal into a spray which is collected on a suitable substrate or die. In the past, almost all products produced with this process required hot working because of the high degree of porosity in the finished product. The problem with porosity is a major concern in this process. The process can produce products of a controlled degree of porosity as shown in U.S. Pat. No. 3,826,301 to Brooks, Column 2, lines 55–60.

The use of powder metallurgy in the production of metal or metal alloy shapes is also well known. Metal powder can be compacted by the use of dies to produce a number of desirable shapes. The produced shapes may be further worked to obtain, as far as it is possible, the desired physical properties. However, one of the limitations to this process is that the final product tends to exhibit undesirable amounts of porosity. Thus, in order to remove the porosity, it has been proposed to subject the finished shape to cold and/or hot working.

A process has been proposed for the direct fabrication of metal shapes of long length and relatively thin cross section by spray casting. The process comprises depositing a plurality of coherent layers of metal onto a substrate by directing sprays of atomized particles of molten metal onto the substrate. Then, a single layer is formed, while the metal is at a temperature above its recrystallization temperature. The metal layer is usually hot worked to provide for improved physical properties. This process is disclosed in U.S. Pat. Nos. 3,670,400 and 4,579,168 to Singer and is particularly applicable to the production of strip. The Singer patents disclose that atomized aluminum can be spray cast onto a moving target, such as a steel belt and the spray formed strip, while still hot, removed and hot rolled to the desired gauge. In this process, metal strip thicknesses of up to about 0.5" may be produced, with the thickness generally ranging from about 0.01 to 0.375".

The Singer patent also states that the porosity of the deposit layers ranges from about 15% to about 20%. When porosity is greater than 15%, a finished product would require hot working before further cold working steps can be performed.

Another prior art method that attempts to deal with the problems of porosity is described in U.S. Pat. No. 3,826,301 to Brooks. The Brooks patent teaches the production of shaped precision metal articles from molten metals and alloys by spray casting onto a die contoured to the shape of the desired article. The method disclosed in Brooks comprises directing an atomized stream of molten metal or metal alloy onto a collecting member to form a deposit and then directly working the deposited material on the collecting member by means of a die to form the desired shape. The purpose of the working is to densify the metal deposit which is porous. This is brought out in Column 2, lines 50–61, of the Brooks patent. Brooks states that the forming operation is normally carried out as soon as the required mass of metal has been deposited onto the die or collecting member. The patent also states that the spray deposit can be cold formed after it has been cooled. Another process for producing elongated metal articles is disclosed in U.S. Pat. No. 4,114,251 to Southern et al. The Southern et al patent discloses a process for producing elongated metal articles by atomizing molten metal and collecting the atomized particles on a moving support. The collected particles are then consolidated by, for example, passing the metal through rolls to form an elongated metal strip.

Another well-known technique for producing a continuous strip of metal is shown in U.S. Pat. No. 3,576,207 to Grenfell. The Grenfell patent discloses a process for continuous casting of metal strip by imparting an electrostatic charge of at least 80,000 volts to a stream of molten metal. The stream of metal is then passed through a nozzle into an inert gas flow and allowed to atomize into a fine spray. The spray droplets are then collected on a receiving surface to form a layer of metal on the collecting member. This is followed by continuously stripping the layer of metal from the collecting member.

In almost all of the above disclosed prior art references, metal articles are produced as either strip, ingots, discs or other shapes, but porosity is a problem in the spray cast products.

Other patent publications relating to the spray casting process include United Kingdom Patent Application Nos. GB 2,172,827A and GB 2,172,900A, European Pat. Applications EP 0,225,732 and EP 0,225,080 and Patent Cooperation Treaty Patent Application WO 87/03012.

The present invention is directed to the process for spray casting a metal or metal alloy wherein the finished product has a minimum of porosity. Thus, the process described by the present invention should eliminate the requirement of hot working the spray cast product. The porosity expected in the spray cast products made in accordance with this invention should be less than 15% and, preferably, less than about 10% by volume.

The process of the instant invention utilizes the techniques taught in Brooks, U.S. Pat. Nos. 3,826,301 and 3,909,921, to atomize molten metal and to deposit the atomized metal onto a collecting member. In performing the instant process, particular care is taken to control the volume fraction of solid of the atomized metal or metal alloy particles as they deposit on the collecting member.

In accordance with the instant invention, a process and apparatus for spray casting a metal or metal alloy is provided wherein the porosity of the produced metal or metal alloy should be substantially minimized. At least one supply of metal or metal alloy is held in a molten state. Then, at least first and second streams of the molten metal or metal alloy are allowed to issue from the supply. Each of the first and second streams is atomized into respective first and second sprays of partially solid particles. Each of the first and second sprays is deposited onto a collecting member. The particles deposited onto the collecting member solidify into a desired shape. The collecting member moves in at least one desired direction. The second spray is arranged to deposit onto the collecting member downstream of the first spray in the desired direction. The first spray deposits onto the collecting member with a first volume fraction of solid. The second spray deposits onto the collecting member with a second volume fraction of solid. The second volume fraction of solid is greater than that of the first volume fraction of solid.

The process of the instant invention may be used to spray cast a metal or metal alloy, to form ingots, to coat articles and to form any desirable shape, especially strip. In a preferred method of the invention, the metal or metal alloy is formed by atomizing the streams of metal or metal alloy by directing respective gas flows at the streams. The temperatures of the gas flows are less than the temperature of the streams of metal or metal alloy.

The volume fraction of solid of the respective metal or metal alloy sprays is controlled by varying: the flow rate of the atomizing gas; and/or the temperature of the atomizing gas; and/or the temperature of the stream of metal or metal alloy; and/or the distance the spray travels to the collecting member; and/or the flow rate of the stream of molten metal or alloy.

Any suitable gas may be used to atomize the stream of molten metal, but preferably the gas is non-oxidizing and inert. For example, nitrogen or argon would be acceptable. However, if oxidation of the particles is not undesirable, compressed air can be used as an atomizing medium. The atomizing step in the process for the present invention will be consistent with that taught in U.S. Pat. No. 3,826,301 to Brooks, which patent is incorporated herein by reference.

SUMMARY OF THE INVENTION

Accordingly, it is an object of this invention to provide a process and apparatus for spray casting a metal or metal alloy to obtain a finished product with a minimum amount of porosity.

It is a further object of the invention to provide a process and apparatus for forming a metal or metal alloy which should eliminate the need for hot working of the product produced by this process.

These and other objects of this invention will become apparent by the following description and drawing.

Embodiments of the process in accordance with the instant invention are shown in the drawings wherein like or primed numerals depict like parts.

Figure 1:
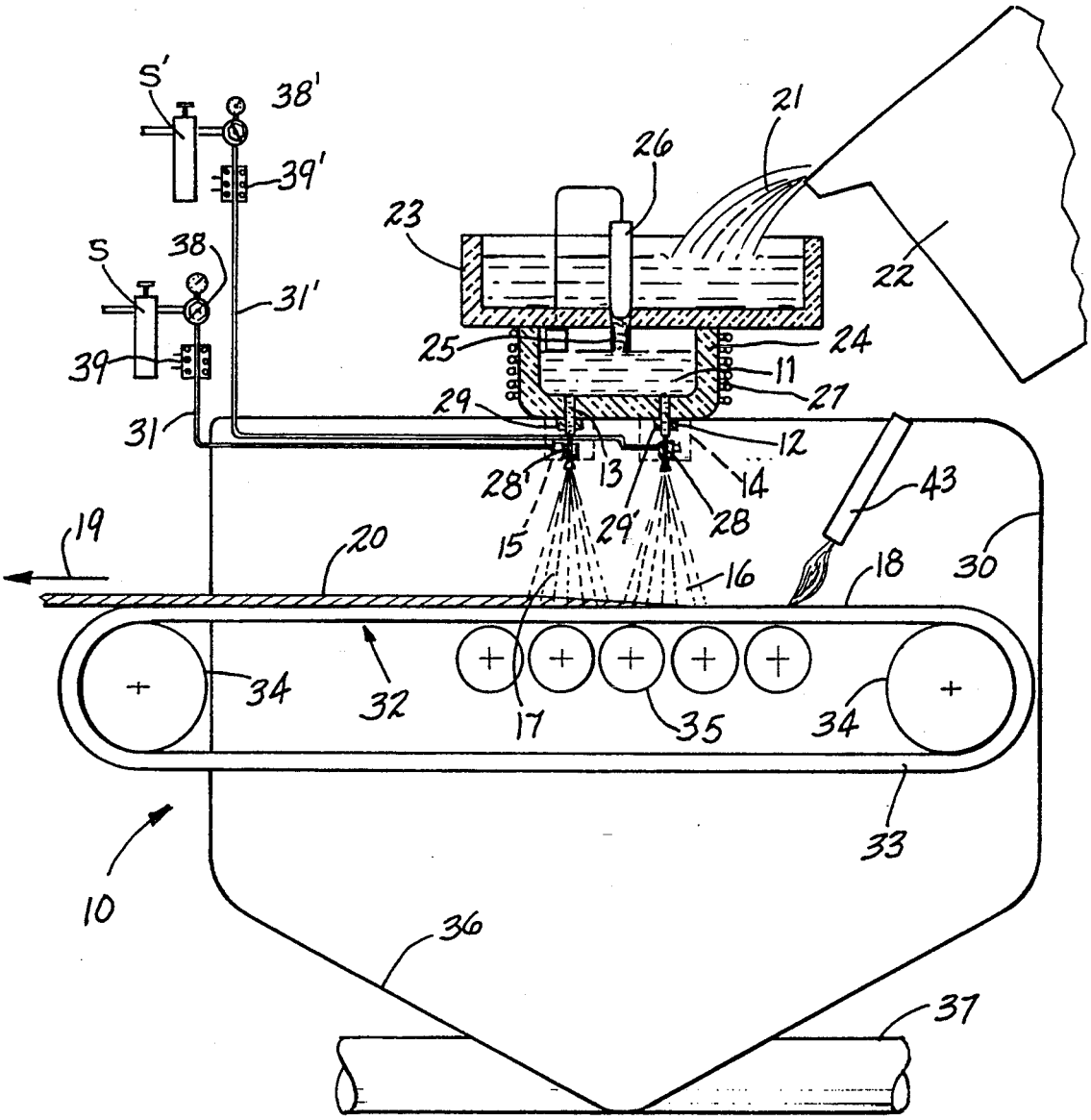
FIG. 1 depicts schematically a spray casting apparatus in accordance with the present invention.

Referring to the drawings and particularly FIG. 1, the instant invention is directed to a process and apparatus 10 for spray casting a metal or metal alloy which has a minimum of porosity and which should not require hot working after it has been produced. The process comprises holding at least one supply 11 of metal or metal alloy in a molten state. Then, allowing at least first 12 and second 13 streams of the metal or metal alloy to issue from the supply 11. Each of the first 12 and second 13 streams of metal or metal alloy are atomized by atomizers 14 and 15 into first 16 and second 17 sprays, respectively, of partially solid particles. Each of the first and second sprays 16 and 17 are deposited onto a collecting member 18 with the particles solidifying into a desired shape. The collecting member 18 moves in a desired direction shown by arrow 19 during deposition. The second spray 17 is arranged to be deposited onto the collecting member 18 downstream of the first spray 16 in the specified desired direction 19.

The first spray 16 which is deposited onto the collecting member 18 has a first volume fraction of solid as it deposits. The second spray 17 that is deposited onto the collecting member 18 has a second volume fraction of solid as it deposits. The second volume fraction of solid is greater than the first volume fraction of solid. With this arrangement the initial deposit on the substrate has a sufficient fraction of liquid to fill the inherent interstices between the splatted droplets on the substrate and provide a proper interface with subsequent deposits. The deposit from the second spray has sufficient solid to ensure that the shape is maintained. Thus, the metal or metal alloy product 20 produced in accordance with this process should contain a minimum amount of porosity. The product 20 should be very high in density. The porosity of the product 20 most preferably is less than about 10%.

In the present invention, a metal or metal alloy may be atomized in the manner taught by U.S. Pat. Nos. 3,826,301, 3,909,921 and Re 31,767 to Brooks and U.S. Pat. Nos. 3,670,400 and 4,579,168 to Singer or any other desired spray casting technique. The present invention is particularly directed to the spray casting of a metal or metal alloy into strip but may be applicable to forming or coating products 20 of any desired shape. For example, the process of the instant invention is particularly useful for making metal or metal alloy strip that can be removed from a collecting member 18 with the collecting member moving at a continuous rate.

The present invention comprises spray casting either a metal or metal alloy and controlling the volume fraction of solid of the particles depositing onto a collecting member 18 to minimize porosity in the finished product 20.

The sprays 16 and 17 of metal or metal alloy particles being deposited onto the collecting member 18 should have different volume fractions of solid. In accordance with this invention, a first spray of particles 16 is deposited onto the collecting member 18. It has a first volume fraction of solid at the time it deposits or impacts thereon. A second spray 17 is subsequently deposited onto the collecting member 18 downstream of the first spray 16. The volume fraction of solid of the second spray of partially solid particles 17 is greater than that of the first spray 16.

The process of making metal or metal alloy products 20 in accordance with the instant invention has several advantages over the prior art methods. First, the deposition techniques should result in a substantial reduction or elimination of the porosity in the product 20. Secondly, the product 20 which is formed by the process of the present invention should not require further hot working.

Referring again to FIG. 1, an apparatus 10 for spray casting the metal or metal alloy is shown. The molten metal or metal alloy 21 is prepared or melted in a furnace 22. It is then poured at a desired rate into trough 23. The molten metal or alloy 21 passes from the trough 23 to the tundish 24 via downspout 25. The flow rate of molten metal 21 into the tundish 24 is controlled by a conventional pin type valve 26 which moves up or down above the downspout 25 to respectively increase or decrease the flow of molten metal 21.

The tundish 24 shown is a holding vessel which is capable of holding the metal or metal alloy at depths of up to 20" or more. A preferred depth for the metal or metal alloy in the tundish 24 is from about 6 to about 12", depending upon the deposition rate to be employed. The tundish 24 should preferably be heated by an external heating mechanism 27 in order to maintain the metal or metal alloy at a desired temperature. Advantageously, the temperature should be up to 200° C. above the melting temperature of the metal or metal alloy. The heating mechanism 27 can be any suitable means for heating the tundish 24, i.e. an induction heating coil attached to the external walls of the tundish 24 would suffice.

It might be mentioned that the temperature of the metal or metal alloy in the tundish 24 is important. The temperature should be sufficiently high to prevent freeze up in the nozzles 28 and 28' attached to the tundish 24. The temperature should be low enough so that the atomized particles solidify rapidly with fine grains and oxygen pickup. It is important that the tundish 24 be preheated before pouring the metal or metal or metal alloy 21 therein. The temperature of the metal or metal alloy 21 in the tundish 24 is monitored by conventional means (not shown) for controlling the external heating mechanism 27. The furnace 22 and trough 23 will continuously or semicontinuously deliver metal or metal alloy to the tundish 24, as desired.

The streams 12 and 13 issue from the tundish 24 through openings referred to as plenums 29. The plenum 29 is an opening in the bottom of the tundish 24. The plenums 29 provide a passageway for the streams 12 or 13 of metal or metal alloy 21 to flow to the nozzles 28 and 28'. At the exit of the plenums 29, there are nozzles 28 and 28' positioned to receive streams 12 or 13. The nozzles 28 and 28' are supported by the tundish 24. The streams 12 or 13 exit the tundish 24 through the plenums 29 and flow into the nozzles 28 and 28'. The streams 12 or 13 are atomized as they exit the nozzles 28 and 28' in the atomizing chambers 14 and 15. The streams 12 or 13 are atomized by conventional means as, for example, those illustrated in U.S. Pat. Nos. 3,826,301 and 3,909,921 to Brooks, 3,670,400 and 4,579,168 fto Singer or 4,066,117 to Clark et al. All of the above patents are incorporated by reference herein. The type of nozzles 28 and 28' used for atomization can be those set forth in the Clark, Singer or Brooks patents.

The flow rate of the molten metal or metal alloy 21 from the tundish 24 is influenced by the throat diameter of the nozzles 28 and 28' and by the head of the metal or the metal alloy in the tundish 24. The flow rate is essentially proportional to the square root of the head height in the tundish 24. The flow rate is also approximately proportional to the throat diameter squared of the nozzles 28 and 28'. Lower flow rates produce smaller atomized particles at a given atomizing gas flow rate.

The nozzles 28 operate in a chamber 30 which preferably has an atmosphere of an inert or non-oxidizing gas. Sufficient space is provided below the tundish 24 for supporting the collecting member 18.

When atomization of the streams 12 and 13 of the metal or metal alloy 21 is complete, they become sprays 16 and 17 of partially solid particles. The sprays 16 and 17 of partially solid particles issue from the nozzles 28 and 28' in a conical shape and are deposited onto the collecting member 18. By employing conically configurated atomized sprays 16 and 17, the bulk of the sprays of partially solid particles are captured by the collecting member 18.

In carrying out the invention, the metal or metal alloy is generally atomized under non-oxidizing conditions. The chamber is purged of oxygen using a non-oxidizing gas and/or a vacuum. The metal or metal alloy is poured into the tundish 24 while maintaining its temperature from about 50° to 200° C. above its melting point. The metal or metal alloy then flows through the plenums 29 located in the bottom of the tundish 24 to form streams 12 and 13. An inert or non-oxidizing gas is supplied under pressure from source S and S' via conduits 31 and 31' to the atomizers 14 and 15 resulting in the atomization of the streams 12 and 13 of metal or metal alloy. In the atomizers 14 and 15, the gas is discharged under pressure. The gas is directed against the streams 12 and 13 to form conically configurated outwardly expanding atomized sprays 16 and 17 of partially solid particles which are directed to the collecting member 18 disposed in the path of the sprays.

The collecting member 18 may be of any conventional design. Preferably, it is an endless surface 18 adapted for continuous operation. For example, a belt type design 32 as shown. The belt 33 may be of any desired material. The belt is driven by rolls 34. Idler rolls 35 support the belt during deposition.

Overspray and exhaust gas are collected by suitable means and removed via an appropriate conduit for disposal, such as conduit 37.

In accordance with the present invention, to minimize porosity the partially solid particles deposited on the collecting member 18 by the first spray 16 should preferably have a volume fraction of solid which is from about 20 to about 60% and, most preferably, from about 30 to about 60%. Preferably, the partially solid particles deposited by the second spray 17 on the deposit from the first spray would have a higher volume fraction of solid of from about 50 to about 90% and, most preferably, from about 60 to about 90%.

There are many parameters for controlling the volume fraction of solid in the sprays 16 and 17 as they deposit. Among these parameters are the gas temperature and/or flow rate during atomization and/or the nozzle to collecting member distance and/or the metal temperature in the tundish and/or the flow rate of the metal or metal alloy.

There are several ways to achieve the respective volume fractions of solid in the first and second sprays 16 and 17. A number of such approaches will be described as embodiments of the present invention although other approaches for achieving the varying volume fractions of solid could be employed as well as combinations of the described approaches.

The following embodiments will be described by reference to FIG. 1.

DESCRIPTION OF THE PREFERRED EMBODIMENTS

In accordance with one embodiment of this invention, a higher volume fraction of solid is provided in the spray 17 as compared to the spray 16 through the use of similar atomizing conditions, namely gas flow rates and temperatures, while having a higher volumetric flow rate of molten metal or alloy 21 passing through nozzle 28 as compared to nozzle 28'. The first spray 16 comprising a larger volume of metal requires a greater amount of heat to be extracted than the spray 16 to achieve the same volume fraction of solid as the spray 17. Since the rate of heat extraction from both sprays 16 and 17 is similar due to the use of similar atomizing conditions the spray 16 will have a small volume fraction of solid than the spray 17.

Achieving a difference in the volumetric flow rate through nozzle 28 as compared to nozzle 28' can be achieved in a variety of ways. The nozzle 28 could have a larger orifice throat diameter than the nozzle 28'. Alternatively, valves in the plenums 29 (not shown) could be used to adjust the respective volumetric flow rates. Alternatively a pin type valve similar to the valve 26 in the trough 23 could be used in association with each of the streams 12 and 13.

In accordance with an alternative embodiment of this invention, the volumetric flow rates of molten metal 21 through the nozzles 28 and 28' are maintained at essentially similar levels. The atomizers 14 and 15 are connected via separate conduits 31' and 31 to different sources S' and S of atomizing gas. The volumetric flow rate of gas through the conduit 31 is adjusted by valve 38 to be higher than the volumetric flow rate of gas through the conduit 31'. The lower flow rate through the conduit 31' is provided by adjusting the valve 38'. The use of a higher volume of atomizing gas for atomizing and cooling the metal issuing from nozzle 28' will result in a higher volume fraction of solid as compared to the spray 16 issuing from nozzle 28.

In accordance with yet another embodiment the atomizing gas provided through conduit 31' is at a higher temperature than the atomizing gas provided through conduit 31. This may be achieved by the use of respective heating or cooling systems 39' and 39 arranged about the respective conduits 31' and 31. If the gas flowing through conduit 31' is at a higher temperature than the gas flowing through conduit 31, then the spray 16 issuing from nozzle 28 will have a lower volume fraction of solid than the spray 17 issuing from nozzle 28'. This occurs since the higher temperature gas will have a reduced cooling effect.

Three different approaches have been illustrated for varying the volume fraction of solid between the respective sprays 16 and 17 using the apparatus 10 of FIG. 1. These approaches can be used individually or in combination as desired to achieve the desired volume fractions of solid in the respective sprays 16 and 17.

Figure 2:
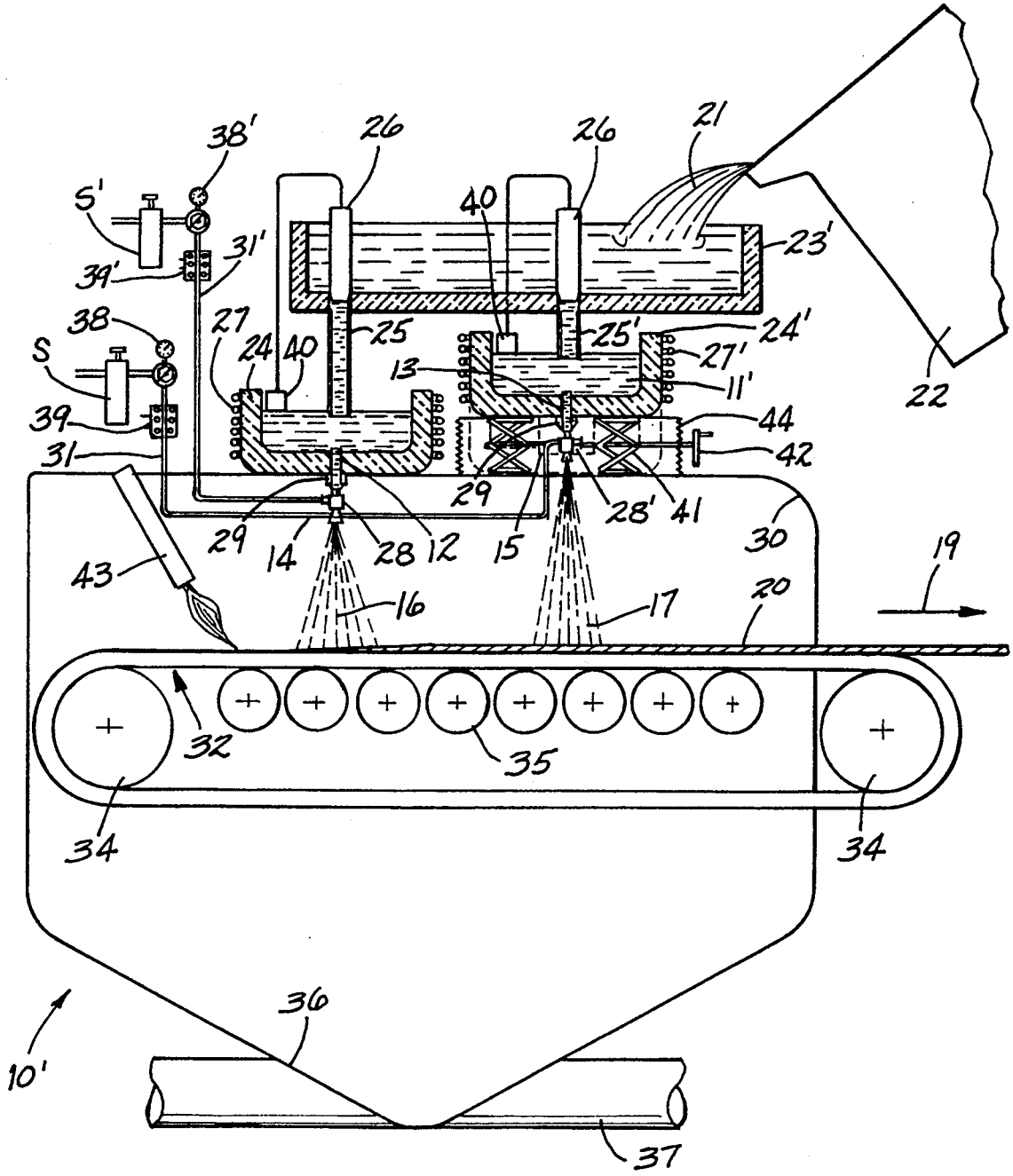
FIG. 2 depicts schematically another embodiment of a spray casting apparatus in accordance with the present invention.

Referring now to FIG. 2, additional alternative embodiments for varying the volume fractions of solid between the respective sprays 16 and 17 will be described. The apparatus 10' in FIG. 2 is similar to the apparatus 10 shown in FIG. 1, except that the direction of movement of the collecting member 18 is opposite. The most significant change in the apparatus of 10' versus 10 is the use of two separate tundishes 24 and 24', one for each respective nozzle 28 and 28' in the apparatus 10'. The use of two tundishes 24 and 24' allows the temperature of the molten metal supply 11 in the first tundish 24 to be varied from the temperature of the molten metal supply 11' in the tundish 24', if desired. Further, the use of two tundishes 24 and 24' allows the respective distance of travel of the spray 17 to be different from the distance traveled by the spray 16.

Since two tundishes 24 and 24' are employed, it is necessary to have two pin valves 26 and 26' controlled by float sensors 40 for controlling the height of the molten metal supply 11 in each tundish 24 and 24'. Further, two downspouts 25 and 25' are employed. When the tundish 24' is in its lowest position, as shown in phantom, which would be employed if it were only desired to vary the temperature of the respective melts 11 and 11', then the downspout 25' would be essentially the same as that shown as 25. However, when the tundish 24' is raised up by jack 41 via crank 42, as shown in solid lines, then the downspout 25' is shorter than the downspout 25. The purpose of the downspouts is to prevent oxidation of the molten metal as it is poured from the trough 23' into the respective tundishes 24 and 24'. A bellows 44 or other suitable means may be provided about the nozzle 28' and spray 17 extending from the bottom of the tundish 24' to the top of the chamber 30 to prevent oxidation of the spray 17 due to expanse to the atmosphere.

If the apparatus 10' is operated under constant conditions of atomization for the respective nozzles 28 and 28', then in accordance with yet another embodiment of this invention the first spray 16 is made to travel a shorter distance from the nozzle 28 to the collecting member 18 than the distance the second spray travels from the nozzle 28' to the depositing product 20. This increase in distance traveled by the second spray 17 will cause its volume fraction of solid to be greater than the first spray since it is subject to cooling for a longer period of time.

In accordance with yet another embodiment of the present invention, the tundishes 24 and 24' would be at the same level (as shown in phantom) and the atomizing conditions essentially the same except that the temperature of the molten metal in supply 11 would be higher than the temperature of the molten metal in the supply 11'. This could be achieved by any desired means and, in particular, by changing the power applied to the heating coil 27 as compared to the heating coil 27' in a manner to provide the desired temperature differential. Since the spray 16 issuing from the nozzle 28 would be at a higher initial temperature than the spray 17 issuing from the nozzle 28', the spray 17 would be expected to have a higher volume fraction of solid as it deposits on the collecting member 18.

As with the embodiments of FIG. 1, the approaches demonstrated in FIG. 2 can be used individually or in combination. Further, they can be used in combination with any or all of the approaches described by reference to FIG. 1.

The ranges of volume fraction of solid for each of the sprays 16 and 17 are of importance. If the volume fraction of solid is below the respective lower limit for the sprays 16 or 17, then the product which is deposited is too liquid making it difficult to maintain its shape. It is also subject to gas porosity. If the upper limit for the respective volume fractions of solid of the sprays 16 and 17 is exceeded, then interconnected porosity is formed which is highly detrimental to the soundness of the product 20. While the mechanism of this invention is not fully understood, it is believed that the different volume fractions of the solid required for the respective first and second sprays 16 and 17 is associated with the fact that the first spray 16 deposits on the collecting member 18; whereas, the second spray deposits on the hot deposit from the first spray.

It is preferred in accordance with this invention that the collecting member surface 18 be preheated prior to receiving the deposit 20 by any desired means such as torch 43. It is believed that preheating the collecting member 18 helps to further reduce porosity in the deposit 20.

To reduce melt oxidation, conventional melt covers or protective atmospheres should be provided over the melt 21 in the furnace 22, trough 23 or 23' and tundish 24 or 24'.

Strip type products which can be formed in accordance with this invention should have a minimum of porosity throughout the bulk of their structure. It is possible, however, that the surface region formed adjacent the collecting member 18 may have an undesirable level of porosity as compared to the remainder of the structure. Any such undesirable surface region can be easily removed by conventional machining, such as milling or skiving techniques to leave a bulk structure having a minimum or no porosity.

While this invention should be applicable to any desired metal or alloy, it is particularly applicable to copper or copper alloys.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

We claim:

1. A process of spray casting a metal or metal alloy comprising the steps:

holding at least one supply of metal or metal alloy in a molten state;

allowing at least first and second streams of said molten metal or metal alloy to issue from said supply;

atomizing each of said first and second streams into a respective first and second sprays of partially solid particles in an atomization chamber having an inert or non-oxidizing atmosphere effective to extract heat from said particles;

depositing each of said first and second sprays onto a collecting member wherein said particles solidify into a desired shape;

moving said collecting member in at least one desired direction during deposition;

said second spray being arranged to deposit onto said collecting member downstream of said first spray in each desired direction;

providing said first spray as it deposits onto said collecting member with a first volume fraction of solid greater than 30%; and providing said second spray as it deposits onto said collecting member with a second volume fraction of solid, said second volume fraction of solid being greater than said first volume fraction of solid whereby the porosity of said metal or metal alloy is substantially minimized.

2. A process as in claim 1 wherein the step of providing said first and second volume fractions of solid comprises adjusting the respective temperatures of said first and second streams so that said first stream is hotter than said second stream.

3. A process as in claim 1 wherein the step of providing said first and second volume fractions of solid comprises arranging said streams so that said second stream travels a greater distance from said supply to said collecting member than said first stream.

4. A process as in claim 1 wherein the step of providing said first and second volume fractions of solid comprises adjusting the respective flow rate of the particles of said first and second streams so that the flow rate of said first stream is greater than that of said second stream.

5. A process as in claim 1 wherein said first volume fraction of solid is from about 30% to about 60%.

6. A process as in claim 1 wherein said second volume fraction of solid is from about 50% to about 90%.

7. A process as in claim 5 wherein said second volume fraction of solid is between 60% and 90%.

8. A process as in claim 1 wherein said atomizing comprises directing respective gas flows at said first and second streams, with the temperature of said gas being less than the temperature of said first and second streams.

9. A process as in claim 8 wherein said gas is an inert gas.

10. A process as in claim 8 wherein said gas is non-oxidizing.

11. A process as in claim 9 wherein said gas is non-oxidizing.

12. A process as in claim 8 wherein the step of providing said first and second volume fractions of solid comprises adjusting the flow rate of said gas so that the gas flow rate directed at said second stream is greater than the gas flow rate directed at said first stream.

13. A process as in claim 8 wherein the step of providing said first and second volume fractions of solid comprises adjusting the temperature of said gas so that said temperature of said second spray is less than that of said first spray as they deposit onto said collecting member.

14. The process described in claim 1 wherein said metal or metal alloy is selected to be copper or a copper alloy.

15. A process as in claim 5 wherein said holding step includes maintaining the temperature of said metal or metal alloy in a molten state at a temperature of from about 50° C. to about 200° C. above the melting point.

16. An apparatus for spray casting a metal or metal alloy comprising:

a means for holding at least one supply of metal or metal alloy in a molten state;

a means for allowing at least a first and second stream of said molten metal or metal alloy to issue from said supply;

a means for atomizing each of said first and second streams into respective first and second sprays of partially solid particles in an atomization chamber having an inert or non-oxidizing atmosphere effective to extract heat from said particles;

a means for collecting deposits of each of said first and second sprays, said means having a collecting member upon said which said particles solidify into a desired shape;

with said collecting means further including a means for moving said collecting member in at least one desired direction during deposition;

said second spray being arranged to deposit onto said collecting member downstream of said first spray in said desired direction;

a means for providing said first spray as it deposits onto said collecting member with a first volume fraction of solid greater than 30%; and a means for providing said second spray as it deposits onto said collecting means with a second volume fraction of solid which is greater than said first volume fraction of solid whereby the porosity of said metal or metal alloy is substantially minimized.

17. An apparatus as in claim 16 wherein the means for providing said first and second volume fractions of solids comprise means for adjusting the respective temperatures of said first and second streams so that said first stream is hotter than that of said second stream.

18. An apparatus as in claim 16 wherein the means for providing said first and second volume fractions of solid comprises arranging said streams so that said second stream travels a greater distance from said holding means to said collecting member than that of said first stream.

19. An apparatus as in claim 16 wherein the means for providing said first and second volume fractions of solid comprises means for adjusting the respective flow rates of said first and second streams so that the flow rate of said first stream is greater than that of said second stream.

20. An apparatus as in claim 16 wherein said first volume fraction of solid is from about 30% to about 60%.

21. An apparatus as in claim 16 wherein said second volume fraction of solid is from about 50% to about 90%.

22. An apparatus as in claim 16 wherein said second volume fraction of solid is from about 60% to about 90%.

23. An apparatus as in claim 16 wherein said means for atomizing comprises means for directing respective gas flows at said first and second streams and means for controlling said respective gas temperatures so that the temperature of the gas directed at said first stream is greater than the temperature of the gas directed at said second stream.

24. An apparatus as in claim 16 wherein said gas flows comprise an inert gas.

25. An apparatus as in claim 16 wherein said gas flows are non-oxidizing.

26. An apparatus as in claim 24 wherein said gas flows are non-oxidizing.

27. An apparatus as in claim 16 wherein said means for providing said first and second volume fractions of solid comprises means for adjusting the rate of flow of said respective gas so that the gas flow rate directed at said second stream is greater than the gas flow rate directed at said first stream.

28. An apparatus as in claim 16 wherein said means for holding at least one supply of metal or metal alloy in a molten state includes a means for maintaining said metal or metal alloy at a temperature of from about 50° C. to about 200° C. above the melting point.

* * * * *